US005947439A

United States Patent [19]

Florey

[11] Patent Number: 5,947,439

[45] Date of Patent: Sep. 7, 1999

[54] CHILDREN'S AND ADULT'S SOAP SAVER

[76] Inventor: Maxine Florey, 3516 Lisburn Rd., Mechanicsburg, Pa. 17055

[21] Appl. No.: 08/123,232

[22] Filed: Sep. 20, 1993

[51] Int. Cl.[6] ..... A47G 29/00

[52] U.S. Cl. ..... 248/683; 248/206.5; 248/309.4; 248/686

[58] Field of Search ..... 248/683, 309.4, 248/206.5

[56] References Cited

U.S. PATENT DOCUMENTS

| | | | |
|---|---|---|---|
| 2,825,177 | 3/1958 | Nordlof et al. | 248/309.4 |
| 3,472,391 | 10/1969 | Bolognesi | 248/309.4 X |
| 3,552,705 | 1/1971 | Caster | 248/309.4 |
| 4,207,975 | 6/1980 | Arzillo | 248/309.4 X |
| 5,368,268 | 11/1994 | Jodwischat | 248/683 X |

FOREIGN PATENT DOCUMENTS

| | | | |
|---|---|---|---|
| 1112926 | 3/1956 | France | 248/309.4 |
| 1542745 | 10/1968 | France | 248/309.4 |
| 1550652 | 12/1968 | France | 2489 309.4 |
| 880914 | 10/1961 | United Kingdom | 248/683 |

*Primary Examiner*—Derek J. Berger
*Attorney, Agent, or Firm*—Robert E. Bushnell, Esq.

[57] ABSTRACT

A cantilevered bracket (10) suspends one component (14) of a magnetized element (14/22) and a magnetically attracted element (22/14) pair, while the other element (22) of the pair is embedded in one major surface of the bar of soap. The edges (32) of the element extending downwards into the bar of soap may be made relatively smooth, with gradual transitions along the edge (32) to eliminate jagged protrusions. The exposed major surface area (18) of the element (14) suspended by the bracket is made substantially greater than the exposed surface area (26) of the element (22) embedded in the major surface area of the bar of soap (30). After using the bar of soap (30), the bar is turned with the embedded element of the pair facing vertically upwardly beneath the suspended element of the pair, while the bar (30) is moved to enable the exposed surface (26) of the embedded element (22) to touch the major surface (18) of the suspended element (14). Once a majority of the exposed surface (26) of the embedded element (22) touches some portion of the major surface (18) of the suspended element (14), the bar of soap (30) may be safely released from the hand of the user without fear that the bracket will drop the bar of soap (30).

20 Claims, 3 Drawing Sheets

CHILDREN'S AND ADULT'S SOAP SAVER

BACKGROUND OF THE INVENTION

1. Field of the Invention

The present invention relates to a soap holder, and more particularly, to a bracket for readily and reliably receiving and magnetically suspending a bar of soap between uses.

2. Background Art

Conventional designs for appliances include dishes of various configurations dedicated to hold bars of soap. After use, surface tension initially encases a bar of soap with a film of water. Generally, conventional designs of soap dishes also retain fluids such as water draining from the film initially clinging by surface tension to the bar of soap. Consequently, even with soap dishes having ribs or self-draining basket inserts, after several intermittent uses of the bar of soap, excessive water accumulates within such dishes, undesirably permitting the bar of soap to lie within the water that has drained from the bar, thereby resulting in partial dissolution of the bar over a period of time into a pool of liquid.

A more recent approach to storage of bars of soap between uses has a small diameter magnet positioned outwardly by a wall mounted bracket to engage and suspend a small metal cap pressed into an upper surface of a bar of soap. In this design, the exposed areas of the magnet and the metal cap are substantially identical and equal in surface area. It has been my observation that unless the exposed areas of the magnet and the metal cap are nearly precisely coaxially aligned, the bracket will "drop" the bar of soap once the bar is released from the hand of the user.

By way of explanation, I have observed that properties probably associated with magnetism such as, perhaps the diminution of magnetic force as a function of distance, as well as the self-centering characteristics of the magnet, require a user to almost precisely position the metal cap in near coaxial alignment with the center of the magnet before releasing the bar of soap, otherwise the bracket will "drop" the bar of soap once the bar has been released from the user's hand, even if the user has managed to have the metal cap touch the magnet before releasing the bar of soap. Consequently, I have found that this design requires greater manual dexterity than is often available from a user, and is that it is accordingly difficult for children, the infirm and aged persons to use, particularly when as is often the case after use of the bar of soap, the bar of soap is wet, very slippery, and is thus extremely difficult for even a very coordinated, healthy adult to grasp. Sometimes, a physically challenged individual must use both hands to return the bar of soap to the bracket. Furthermore, the metal cap has jagged edges to facilitate its insertion into the bar of soap; it seems to me therefore, that there is always an unnecessary risk that if removed from the bar of soap by a child, either that the jagged edges of the cap could injure a child (e.g., particularly if the cap has been dropped onto a bathroom floor and stepped upon by a barefooted child) or that the smallness of the metal cap will enable a child to swallow the cap.

SUMMARY OF THE INVENTION

It is therefore, one object of the present invention to provide an improved appliance for storing a bar of soap between uses of the soap.

It is another object to provide an appliance that enables water to drain from a recently used bar of soap while suspending that bar of soap in a storage position where that bar of soap will not come into contact with the water which has drained from that bar of soap.

It is still another object to provide an appliance readily amenable for use by children, the infirm and the aged, for storing a bar of soap between uses.

It is yet another object to provide an appliance that is easily usable by children, the infirm and the aged, for suspending a bar of soap by the uppermost surface of the bar between uses of the bar of soap.

It is still yet another object to provide an appliance that may be reliably used without a requirement for manual accuracy in alignment when replacing a recently used bar of soap, and which enables water to drain from the bar of soap while suspending that bar of soap in a storage position where that bar of soap will not come into contact with the water which has drained from that bar of soap.

It is a further object to provide an improved appliance for enabling a user to magnetically suspend a bar of soap from an overhead bracket between uses of the bar of soap, with but a minimum of manual dexterity.

It is a yet further object to provide an improved appliance for enabling a user to magnetically suspend a bar of soap from an overhead bracket between uses of the bar of soap, with only one hand.

It is a still further object to provide a safer insert for enabling magnetic suspension of a bar of soap between uses.

These and other objects may be achieved according to the principles of the present invention with a cantilevered bracket suspending one component of a magnetized element and a magnetically attracted element pair, while the other element of the pair is embedded in one major surface of the bar of soap. The edges of the element extending downward into the bar of soap may be made relatively smooth, with gradual transitions along the edges to eliminate jagged protrusions. The exposed major surface area of the element suspended by the bracket is made substantially greater than the exposed surface area of the element embedded in the major surface area of the bar of soap. After using the bar of soap, the bar is turned with the embedded element of the pair facing vertically upwardly beneath the suspended element of the pair, while the bar is moved to enable the exposed surface of the embedded element to touch the major surface of the suspended element. Once a majority of the exposed surface of the embedded element touches some portion of the major surface of the suspended element, the bar of soap may be safely released from the hand of the user without fear that the bracket will drop the bar of soap.

The present invention will now be described more specifically with reference to the drawings attached only by way of example.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
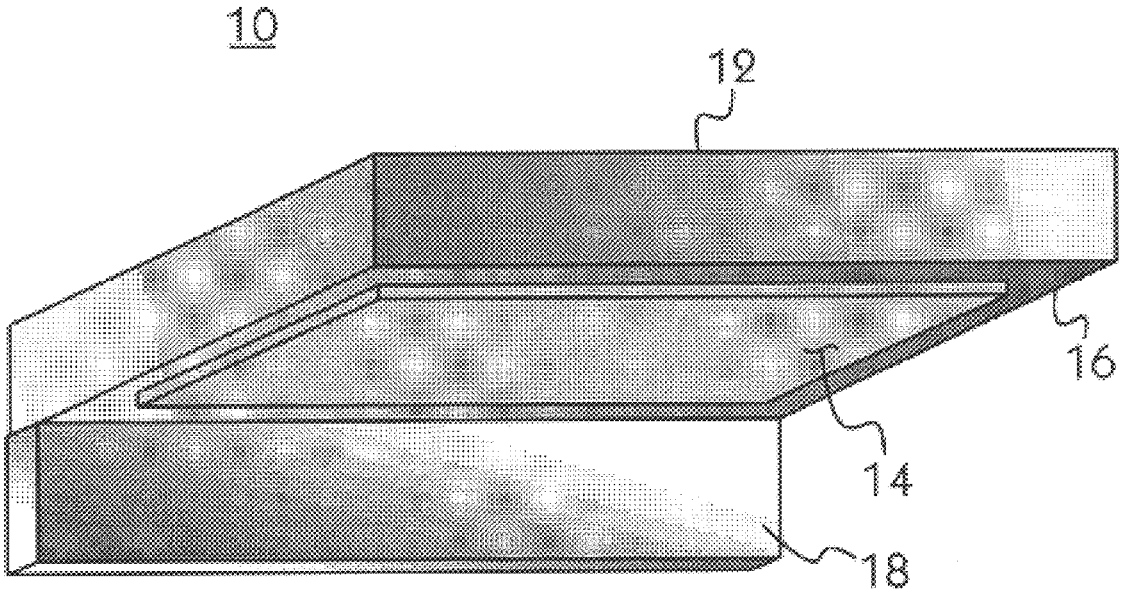
FIG. 1 is a perspective view illustrating the structure of one embodiment constructed according to the principles of the present invention.

Turning now to the drawings, FIG. 1 shows in a perspective view, one embodiment constructed according to the principles of the invention disclosed herein. Bracket 10 may be formed with a generally horizontally disposed, levered member 12 formed, as shown, perhaps as a parallelapipe, and a descending, vertical member 18 joining the proximal end of member 12. The under surface 16 of horizontal member 12, in one embodiment, a member 14, formed, by way of example, from a thin layer exhibiting magnetic properties, is affixed to surface 16 to extend substantially co-extensively with the surface area of under surface 16, and to lie in the plane substantially co-planer with the undersurface are 16. In an alternative embodiment, member 14 may be made of a material attractively responding to a magnetic member such as the permanent magnet.

It is contemplated that bracket 10 be mounted upon a vertical wall with, for example, a length of double-sided adhesive tape. Alternatively, bracket 10 could be bolted to the vertical wall. Regardless however, of how bracket 10 is mounted upon a vertical wall, under surface 16 should be oriented in a substantially horizontal plane, generally perpendicular to the plane of the vertical wall.

Figure 2:
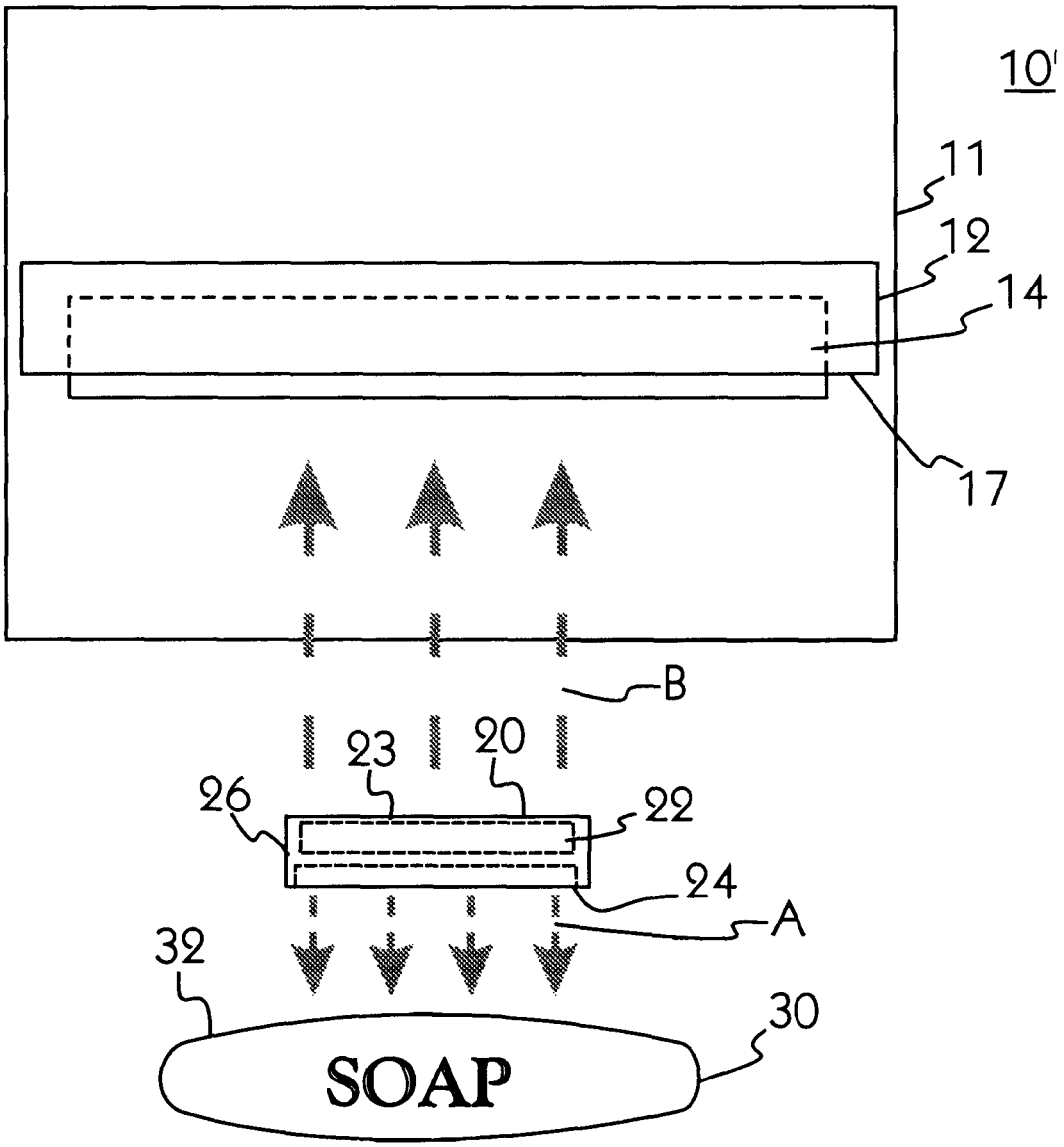
FIG. 2 is a plan view illustrating another embodiment constructed according to the principles of the present invention.
Figure 3:
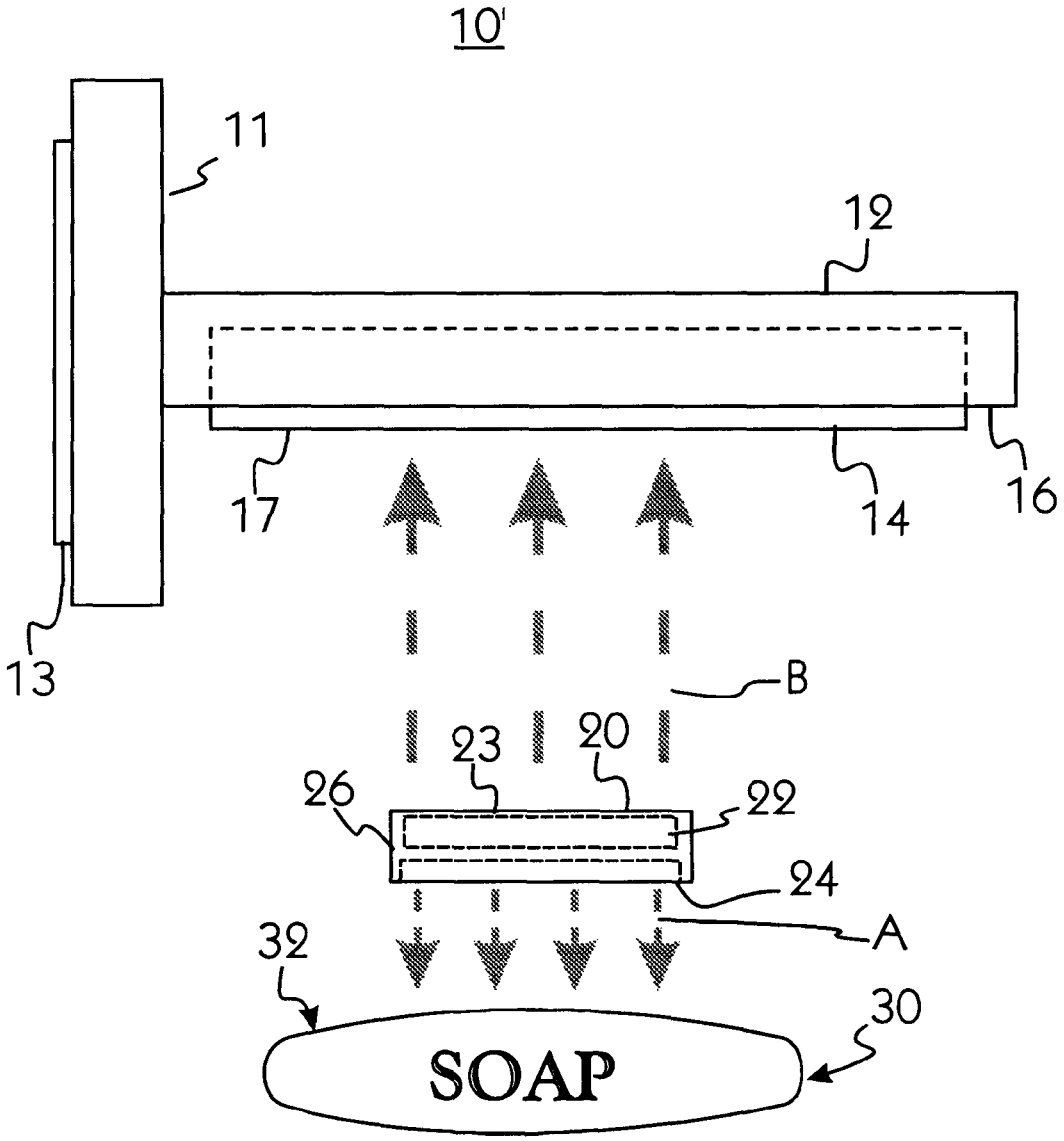
FIG. 3 is a side view of the embodiment shown in FIG. 2.

Turning now to FIGS. 2 and 3, a second embodiment is disclosed with bracket 10' formed with a vertically extending member 11 supporting a levered generally horizontally extending member 12. The proximal end of horizontal member 12 is centrally joined to vertical member 11. A length of double-sided adhesive tape 13, for example, may be placed on the opposite vertical major surface of vertical member 11, opposite from the proximal end of horizontal end 12, in order to enable vertical member 11 to be adhesively attached to a vertical wall. Again, the undersurface 16 should lie in a generally horizontal plane. An element 14 such as, in one embodiment, a permanent magnet, may be force fed into a recess within horizontal member 12, to thereby expose an undersurface 17 generally co-extensive with an horizontally disclosed along undersuface 16.

An insert 20 responsively attached to a permanent magnet, is constructed to encase either, in one embodiment, a magnetic material such as permanent magnet 22, and in an alternative embodiment, a material attractively responding to a permanent magnet 22. Member 22 is placed closer to the upper most surface 23 of insert 20. The undersurface of insert 20 defines a recessed cavity 24. In essence, insert 20 defines a non-magnetic skirt 26 as, for example, defining a cylinder surrounding member 22 and extending perpendicularly from the undersurface 17 of member 14. Accordingly, insert 20 may be pressed along the direction of arrows A into one major surface 32 of a bar of soap 30. The force of the insertion of insert 20, together with the interaction of cavity 24 (as filled with soap) and vertical skirt 26, will retain insert 20 within major surface 32.

Subsequently, the bar of soap 30 may be raised vertically along the direction of arrows B with insert 20 facing upwardly, until insert 20 engages the exposed surface 17 of member 14. If both members 14 and 22 are permanent magnets or permanent magnetic materials, with opposite polar orientations, engagement between undersurface 17 and insert 20 will allow horizontal member 12 to suspend insert 20 and the bar of soap 30 retained by insert 20, along the undersurface 16 occupied member 14. Alternatively, if only one of member 14 or 22 is a permanent magnet, and the other one of member 14 or 22 is a magnetically attracted material such as a layer of steel or iron, a force of magnetic attraction (assuming the fixed position of bracket 10') will also allow insert 20 and the bar of soap 30 grasped by insert 20, to be suspended from member 14. In this position, water may freely drain from bar of soap 30 while bar of soap 30 remains in an unobtrusive, storage position.

As shown, the mating surface areas 17, 23 of member 14, 22 respectively, differ in size. Preferably, the exposed surface area 17 of member 14 is at least twice and preferably more than twice the surface area of member 22. This advantageously assures that when bar of soap 30 engages under surface 16 with a proximity of contact between members 14, 22, the coextensive area of contact will be sufficient to assure that insert 20 and its retained bar of soap 30 will be securely supported by bracket 10'. Moreover, this difference in surface areas provides a user with an extremely wide area of target along surface 17, thereby minimizing the possibility of achieving no co-extensive engagement between surfaces 17, 23 on the first attempt to "hang-up" bar of soap 30.

For most applications of the invention described herein, insert 20 should preferably be made relatively small in relation to the size of the bar of soap in order to avoid obscuring a major portion of the surface of bar of soap 30 and thereby interfering with ordinary use of the bar of soap.

With the embodiments shown, the horizontal member provides an upper horizontal surface that may serve as a shelf, as for example, a water tumbler or an extra bar of soap.

Of course, a structure constructed according to the foregoing principles may be incorporated into other sanitary appliances (e.g., in combination with a bathroom toothbrush holder) suitable for use in kitchen, bathroom, and other facilities where bars of soap are used. Preferably however, the strength of the permanent magnet is sufficient to securely retain the bar of soap after the bar has been returned to the bracket. Moreover, the embodiments constructed according to the foregoing principles accommodate a wider range of manufacturing and operational design configurations and ornamental aspects without impairing the reliability of the invention and its enablement of children, the aged and the infirm to easily replace a bar of soap in suspension from the bracket.

Various modifications and alterations may be made to the embodiments disclosed without departing from the principles of the current invention, and applications other than those disclosed here may be pursued in the practice of the principles disclosed.

What is claimed is:

1. An appliance, comprising:

a pair of elements comprised of a magnetic element and a magnetically attracted element;

said magnetic element comprising a first major surface defined by a first width and by a first length taken along a direction orthogonal to said first width;

a bracket comprising a cantilevered member having a lower surface that is substantially coextensive in surface area with said magnetic element, said lower surface supporting said magnetic element in a plane having an orientation other than vertical with said first major surface exposed to engage said magnetically attracted element;

said magnetically attracted element comprising a second major surface defined by a second width taken along a direction parallel to said first width, and by a second length taken along a direction parallel to said first length, said first width being substantially greater in value than said second width and said first length being substantially greater in value than said second length, and said magnetically attracted element comprising an edge disposed opposite from said second major surface, extending away from said second major surface to engage an outer surface of a bar of soap while maintaining said second major surface exposed to magnetically engage said first major surface;

said first major surface providing surface area comparable in size to the outer surface and more than an integer multiple not less than two greater in surface area than said second major surface;

said second major surface having surface area significantly smaller in size than the outer surface; and said magnetic element receiving and adapted to securely retain the bar of soap bearing an exposed said second major surface of said magnetically attracted element embedded within the bar of soap, despite an absence of concentric alignment between said first major surface and said second major surface.

2. The appliance of claim 1, further comprised of said bracket comprising:

a first member having a reverse surface configured to lie upon a vertically extending surface; and said cantilevered member having a proximal end joined to said first member, said cantilevered member having said lower surface extending horizontally outwardly from said first member while said first member lies upon the vertically extending surface, said lower surface supporting said magnetic element within a horizontal plane extending horizontally outwardly from said first member.

3. The appliance of claim 2, further comprised of said bracket comprising said cantilevered member having said lower surface forming a recess, said magnetic element being receivable within said recess.

4. The appliance of claim 2, further comprised of said bracket comprising said cantilevered member having said lower surface perforated by a recess configured to receive and retain said magnetic element.

5. The appliance of claim 1, further comprised of said magnetically attracted element comprising:

a component made of a ferromagnetic material; and said edge defining a volume disposed beneath said magnetically attracted element, for receiving a portion of the bar of soap as said magnetically attracted element is forced into the bar of soap.

6. The appliance of claim 1, further comprised of said first major surface having an area not less than twice said second major surface.

7. An appliance, comprising:

a pair of elements respectively comprising a first major surface and a second major surface;

a bracket comprising a cantilevered member affixed to one of said pair of elements with an orientation of a corresponding one of said first major surface and said second major surface belonging to said one of said pair of elements affixed to said bracket lying in a substantially horizontal plane facing downwardly;

one of said pair of elements not affixed to said bracket further comprising means for retentively engaging an object having a mass greater than said one of said pair of elements not affixed to said bracket, with said second major surface oriented towards said first major surface;

said first major surface belonging to said one of said pair of elements affixed to said bracket comprising an area not less than twice an area of said second major surface;

said first major surface being defined by a first width and by a first length taken along a direction orthogonal to said second width;

said second major surface being defined by a second width taken along a direction parallel to said first width, and by a second length taken along a direction parallel to said first length, said first width being substantially greater in value than said second width and said first length being substantially greater in value than said second length;

said one of said pair of elements affixed to said bracket exhibiting an ability to attract said one of said pair of elements not affixed to said bracket to enable said second major surface to engage and retain a portion of said first major surface comprising less than all of said first major surface, despite an absence of concentric alignment between said first major surface and said second major surface.

8. The appliance of claim 7, further comprised of said one of said pair of elements affixed to said bracket comprising a permanent magnet.

9. The appliance of claim 7, further comprised of said one of said pair of elements not affixed to said bracket comprising a permanent magnet.

10. The appliance of claim 7, further comprised of:

said one of said pair of elements affixed to said bracket comprising a permanent magnet; and said one of said pair of elements not affixed to said bracket comprising a permanent magnet.

11. The appliance of claim 7, further comprised of said bracket comprising:

a vertical member; and a horizontal member comprising a proximal end joined to and extending horizontally outward from said vertical member, said horizontal member providing a lower horizontal surface supporting said one of said pair of elements affixed to said bracket.

12. The appliance of claim 11, further comprised of said horizontal member comprising an upper surface providing a shelf.

13. The applicance of claim 11, further comprised of said one of said pair of elements affixed to said bracket comprising a permanent magnet.

14. The appliance of claim 11, further comprised of said one of said pair of elements not affixed to said bracket comprising a permanent magnet.

15. The appliance of claim 11, further comprised of:

said one of said pair of elements affixed to said bracket comprising a permanent magnet; and said one of said pair of elements not affixed to said bracket comprising a permanent magnet.

16. The appliance of claim 7, further comprised of said one of said pair of elements affixed to said bracket exhibiting an ability to magnetically attract said one of said pair of elements not affixed to said bracket.

17. An appliance, comprising:

a first element comprised of a magnetic material having a first surface;

a second element comprised of a magnetically attracted material having a second surface;

said first surface being defined by a first width and by a first length taken along a direction orthogonal to said first width;

said second surface being defined by a second width taken along a direction parallel to said first width, and by a second length taken along a direction parallel to said first length, said first width being substantially greater in value than said second width and said first length being substantially greater in value than said second length;

a bracket comprising a cantilevered member having a lower surface that is substantially coextensive in surface area with said first element, said lower surface supporting said first element with said first element exhibiting an orientation other than vertical and with said first surface being exposed to engage said second surface of said second element;

means, integral with said second element, disposed opposite to and extending away from said second surface, for engaging an outer surface of a bar of soap while maintaining said second surface exposed to engage said first surface;

said first surface providing surface area comparable in size to the outer surface and not less than two times greater in area than said second surface;

said second surface having surface area substantially smaller than the outer surface; and said first element receiving and able to securely retain the bar of soap bearing an exposed said second surface of said second element embedded within the bar of soap, despite an absence of concentric alignment between said first surface and said second surface.

18. The appliance of claim 17, further comprised of said bracket comprising said cantilevered member having said lower surface forming a recess, said first element being receivable within said recess.

19. The appliance of claim 17, further comprised of said bracket comprising said cantilevered member having said lower surface perforated with a recess configured to receive and retain said first element.

20. The appliance of claim 17, further comprised of said means for engaging said bar of soap comprising an edge defining a volume disposed beneath said second element, said volume for receiving a portion of the bar of soap as said second element is forced into the bar of soap.

* * * * *